US012239266B2

(12) United States Patent
Wright et al.

(10) Patent No.: US 12,239,266 B2
(45) Date of Patent: Mar. 4, 2025

(54) EXTRACTOR CLEANING MACHINE

(71) Applicant: Techtronic Floor Care Technology Limited, Tortola (VG)

(72) Inventors: Michael Wright, Wadsworth, OH (US); John Bantum, Munroe Falls, OH (US); Marlee Poitinger, Cleveland, OH (US); Rafael Davila, Kannapolis, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 373 days.

(21) Appl. No.: 17/576,586

(22) Filed: Jan. 14, 2022

(65) Prior Publication Data

US 2022/0133113 A1 May 5, 2022

Related U.S. Application Data

(63) Continuation of application No. 15/270,897, filed on Sep. 20, 2016, now abandoned.
(Continued)

(51) Int. Cl.
*A47L 11/30* (2006.01)
*A47L 11/34* (2006.01)
*A47L 11/40* (2006.01)

(52) U.S. Cl.
CPC ..... *A47L 11/30* (2013.01); *A47L 11/34* (2013.01); *A47L 11/4008* (2013.01);
(Continued)

(58) Field of Classification Search
CPC .... A47L 7/0061; A47L 7/0057; A47L 7/0019; A47L 9/0027; A47L 9/0045; A47L 11/4088; A46B 17/06; A46B 17/065
(Continued)

(56) References Cited

U.S. PATENT DOCUMENTS 2,475,815 A 7/1949 Burd
4,974,618 A 12/1990 Nysted
(Continued)

FOREIGN PATENT DOCUMENTS

CN 202235158 U 5/2012
CN 102652656 A 9/2012
(Continued)

OTHER PUBLICATIONS

Chinese Patent Office First Action for Application No. 201680065912.4 dated Apr. 24, 2020 (13 pages including statement of relevance).
(Continued)

*Primary Examiner* — Bryan R Muller
(74) *Attorney, Agent, or Firm* — Michael Best & Friedrich LLP

(57) ABSTRACT

A handheld extractor that includes a housing, a supply tank adjacent a first side of the housing, and a recovery tank adjacent a second side of the housing. A cleaning chamber is in the third side of the housing. A fluid flow path is between the supply tank and the cleaning chamber. The cleaning chamber receives a suction nozzle and a suction source provides suction through a hose and the second fluid flow path to extract the cleaning fluid from the supply tank, along the fluid flow path into the cleaning chamber, through the hose and into the recovery tank to flush the cleaning fluid through the hose to clean the hose when the suction nozzle is received in the cleaning chamber.

18 Claims, 18 Drawing Sheets

Related U.S. Application Data

(60) Provisional application No. 62/253,920, filed on Nov. 11, 2015.

(52) U.S. Cl.
CPC ..... *A47L 11/4016* (2013.01); *A47L 11/4036* (2013.01); *A47L 11/4083* (2013.01); *A47L 11/4088* (2013.01)

(58) Field of Classification Search
USPC ..... 15/321–322
See application file for complete search history.

(56) References Cited

U.S. PATENT DOCUMENTS

| | | | | |
|---|---|---|---|---|
| 5,870,798 | A * | 2/1999 | Crouser | A47L 7/0042 15/387 |
| 6,041,470 | A | 3/2000 | Branham et al. | |
| 6,453,507 | B1 | 9/2002 | Gilbert | |
| 6,802,104 | B1 | 10/2004 | Redd | |
| 7,073,226 | B1 * | 7/2006 | Lenkiewicz | A47L 11/4083 15/327.2 |
| 7,104,474 | B2 * | 9/2006 | Katz | B08B 9/0826 239/459 |
| 7,703,170 | B2 * | 4/2010 | Orubor | E01H 1/0827 15/322 |
| 7,854,033 | B1 | 12/2010 | Kinder | |
| 8,549,697 | B1 * | 10/2013 | Moyher, Jr. | A47L 11/4008 15/319 |
| 8,635,738 | B2 | 1/2014 | Zita | |
| 8,776,304 | B2 | 7/2014 | Orubor | |
| 8,925,142 | B2 | 1/2015 | Orubor | |
| 2001/0002499 | A1 * | 6/2001 | Lindquist | A47L 13/502 15/310 |
| 2005/0015916 | A1 | 1/2005 | Orubor | |
| 2006/0000048 | A1 | 1/2006 | Rosenzweig et al. | |
| 2006/0137132 | A1 | 6/2006 | Orubor | |
| 2009/0070953 | A1 | 3/2009 | Orubor | |
| 2012/0117750 | A1 | 5/2012 | Orubor | |
| 2012/0192376 | A1 | 8/2012 | Orubor | |
| 2013/0117959 | A1 | 5/2013 | Stryker et al. | |
| 2013/0269144 | A1 | 10/2013 | Orubor | |
| 2013/0318741 | A1 | 12/2013 | Moyher, Jr. et al. | |
| 2015/0245751 | A1 | 9/2015 | Wall et al. | |

FOREIGN PATENT DOCUMENTS

| | | | |
|---|---|---|---|
| CN | 102688002 | A | 9/2012 |
| CN | 204467955 | U | 7/2015 |
| EP | 1230870 | A2 | 8/2002 |
| WO | 2015000505 | A1 | 1/2015 |

OTHER PUBLICATIONS

European Patent Office Notice of Opposition for Application No. 16778560.9 dated Mar. 16, 2020 (12 pages).

International Search Report and Written Opinion for Application No. PCT/US2016/052687 dated Jan. 2, 2017 (16 pages).

* cited by examiner

EXTRACTOR CLEANING MACHINE

CROSS-REFERENCE TO RELATED APPLICATIONS

This application is a continuation of U.S. patent application Ser. No. 15/270,897, filed Sep. 20, 2016, which claims priority to U.S. Provisional Patent Application No. 62/253,920, filed Nov. 11, 2015, the entire contents all of which are hereby incorporated by reference.

BACKGROUND

The present invention relates to extractor cleaning machines and, more particularly, to self-cleaning extractor cleaning machines.

Typically, extractor cleaning machines include components for applying a fluid to a surface and extracting the fluid from the surface. For example, extractor cleaning machines may include a fluid distribution system, an agitator brush, a pump, and a suction fan. The agitator brush is used to scrub the surface being cleaned. The suction fan generates a vacuum force that draws in fluid, dirt, or waste from the surface being cleaned. Some extractor machines include an accessory hose assembly and tools to clean above-floor surfaces. For example, the accessory tools may be used for cleaning drapes, steps, and furniture. The accessory hose assembly provides a conduit for drawing fluid and dirt from the surface to the extractor and sometimes also distributes cleaning fluid using a pump.

SUMMARY

In one embodiment, the invention provides an extractor including a housing, a suction source disposed within the housing, and a suction nozzle in communication with the suction source and movable relative to the housing. The extractor also includes a recovery tank carried by the housing, and the suction source is in communication with the recovery tank for drawing fluid through the suction nozzle and storing the drawn fluid in the recovery tank. A cleaning chamber disposed on the housing receives a portion of the suction nozzle, and the cleaning chamber is configured to selectively receive a fluid along a fluid flow path in communication with the cleaning chamber.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
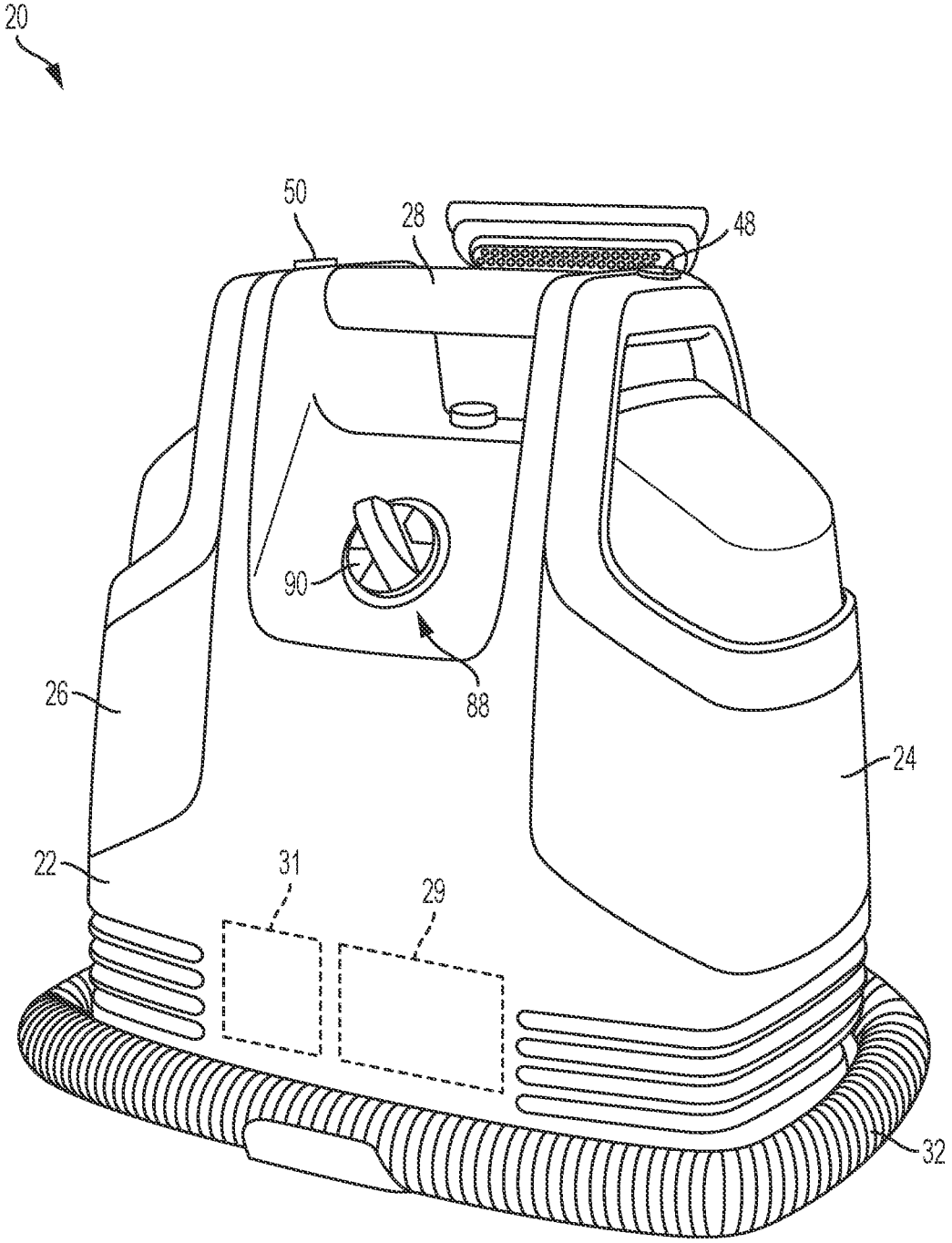
FIG. 1 is a front perspective view of an extractor in accordance with one embodiment of the invention.

FIG. 1 illustrates an extractor cleaning machine 20 (hereinafter referred to simply as an "extractor"). In the illustrated embodiment, the extractor 20 is typically referred to as a portable, a handheld, or canister-type extractor that is operable to clean a surface such as, for example, a floor. In other embodiments, the extractor 20 may be, for example, an upright extractor. In some embodiments, the extractor 20 is adapted to clean a variety of surfaces, such as carpets, upholstery, curtains, hardwood floors, tiles, or the like. The extractor 20 typically distributes or sprays a cleaning fluid (e.g., water, sanitizer, detergent, or a mixture of water and sanitizer or detergent) onto the surface to clean the surface. The extractor 20 then draws the cleaning fluid and dirt off of the surface, leaving the surface relatively clean.

Figure 2:
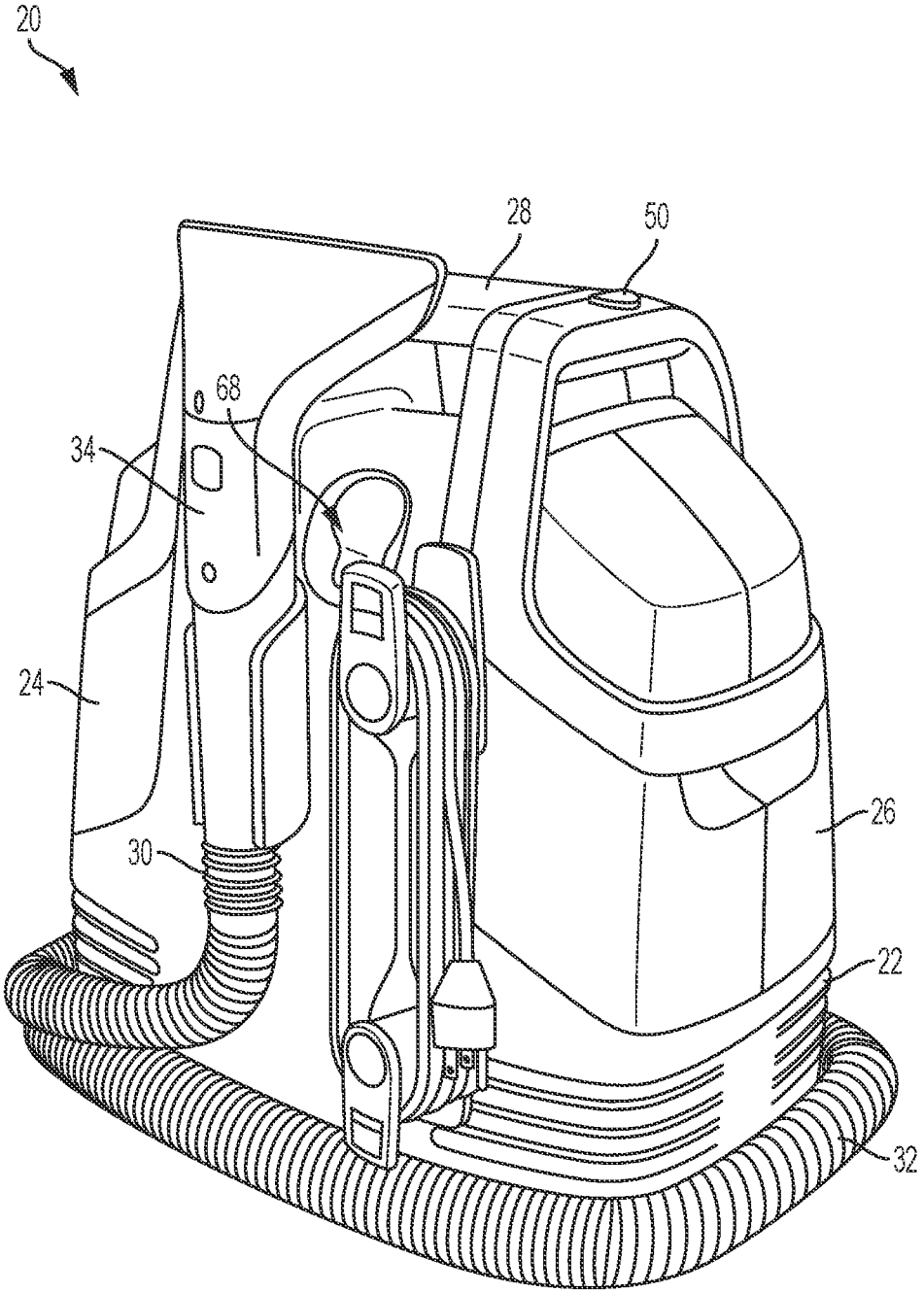
FIG. 2 is a rear perspective view of the extractor of FIG. 1.

The illustrated extractor 20 includes a housing 22, a supply tank 24 for storing a cleaning fluid, and a recovery tank 26 for storing dirty fluid. Both the supply tank 24 and the recovery tank 26 are carried by the housing 22. A handle 28 is coupled to the housing 22 to facilitate moving and carrying the extractor 20. The extractor 20 also includes a suction source 29 (shown in broken lines in FIG. 1) supported by and disposed within the housing. The suction source 29 is driven by a motor 31 (shown schematically in broken lines in FIG. 1) that is powered (by line or battery) to selectively drive the suction source 29. The suction source 29 is operable to draw the cleaning fluid and dirt from the surface. Specifically, the suction source 29 is in communication with the recovery tank 26 for storing the drawn cleaning fluid and dirt in the recovery tank 26. The extractor 20 further includes a hose end 30 in communication with the suction source 29 and moveable relative to the housing 22 (FIG. 2). The hose end 30 is extended from the suction source 29 via a hose 32. When left exposed, the hose end 30 is a suction nozzle. The hose end 30 may be gripped by an operator for movement of the hose 32 and hose end 30 for cleaning.

Figure 3:
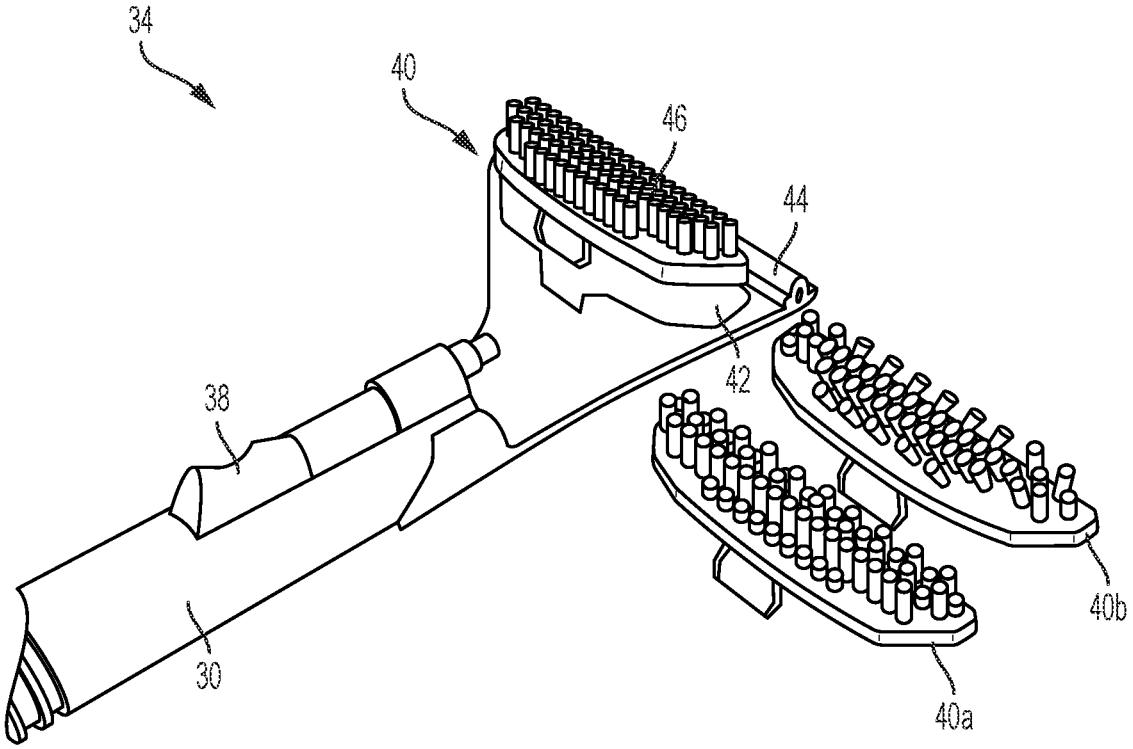
FIG. 3 is a perspective view of an accessory tool of the extractor of FIG. 1.

With reference to FIGS. 2 and 3, the extractor 20 may include an accessory tool 34 for cleaning the surfaces and when connected to the hose end 30 the accessory tool 34 is in communication with the suction source 29. In one embodiment illustrated in FIG. 2, the accessory tool 34 may be stored on the housing 22 when not in use. While in use and attached to the hose end 30, an operator can grip the hose end 30, the accessory tool 34, or both to move the accessory tool 34 for cleaning. The accessory tool 34 includes a cleaning head 40 with an intake nozzle 44 that operates as a suction nozzle when connected to the hose end 30 for drawing dirty fluid from a surface. In the illustrated embodiment, the cleaning head 40 includes a non-powered agitator, e.g., a brush 46, to help scrub or otherwise clean a surface. Also, the cleaning head 40 of the illustrated embodiment is removable from the accessory tool 34 such that different cleaning heads (i.e., 40*a*, 40*b*, etc.) can be used to clean surfaces (e.g., furniture, drapes, steps, etc.). In other embodiments, the cleaning head 40 may include a motor or turbine-powered agitator and/or removable or non-removable cleaning heads.

Figure 4:
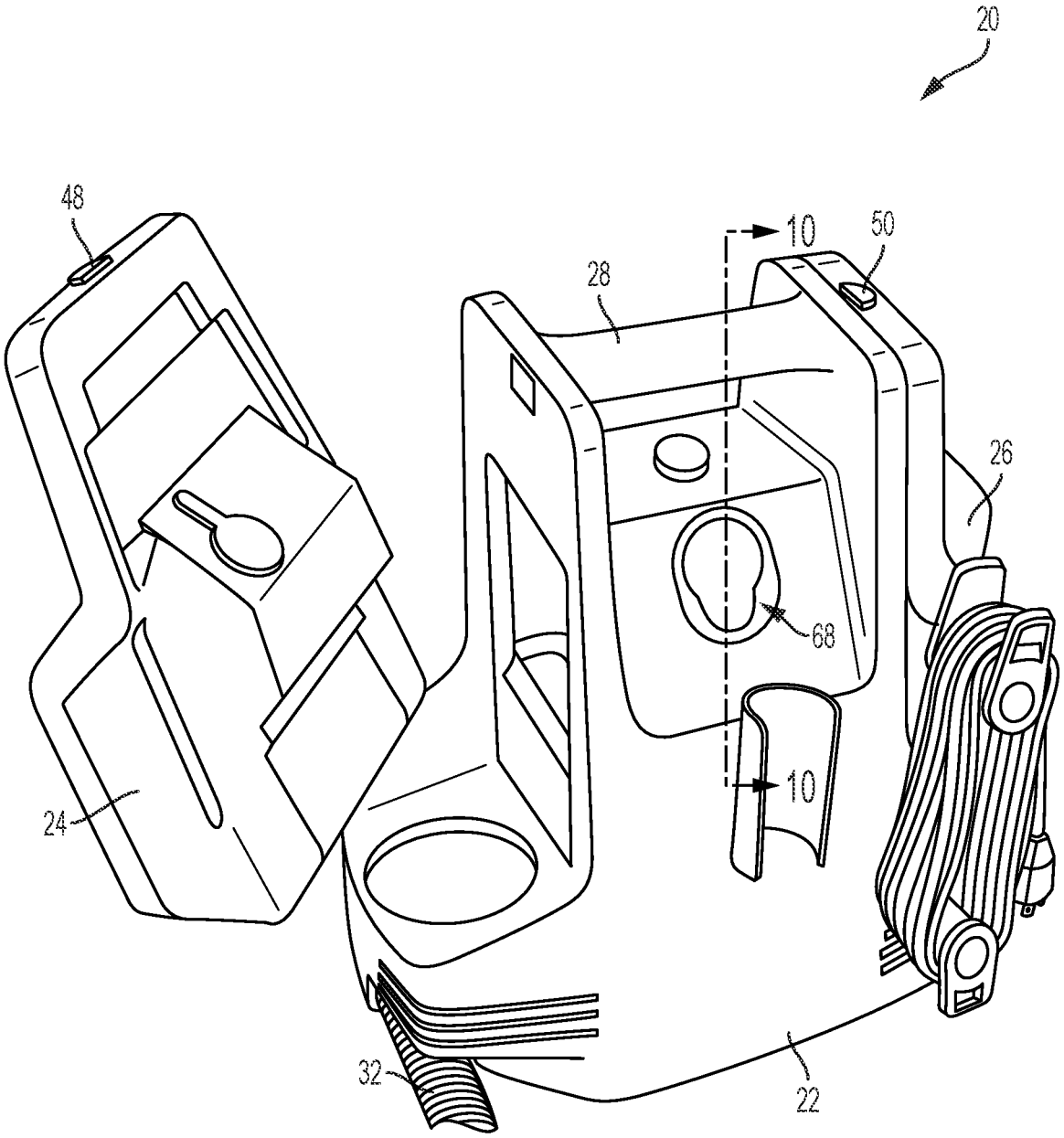
FIG. 4 is a perspective view of the extractor of FIG. 1, illustrating a supply tank removed from a housing of the extractor.
Figure 5:
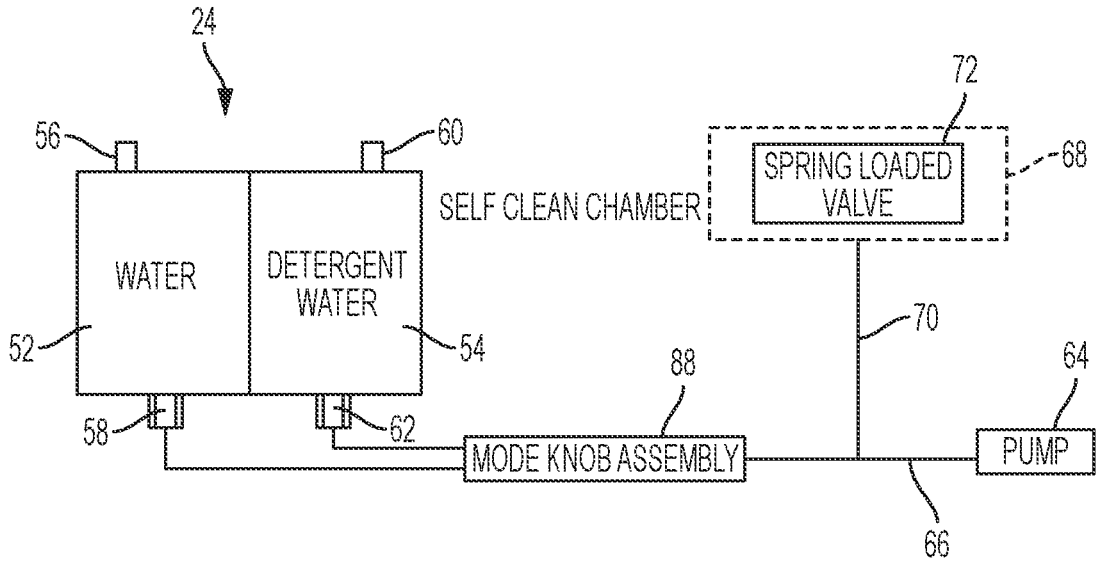
FIG. 5 is a schematic view of a portion of the extractor of FIG. 1, illustrating a supply tank, a mode valve assembly, and a cleaning chamber.

With reference to FIGS. 4 and 5, the supply tank 24 of the extractor 20 is removeably coupled to the housing 22. The supply tank 24 may be retained via a latch mechanism 48. Similarly, the recovery tank 26 is also removeably coupled to the housing 22. The recover tank 26 may be retained via a separate latch mechanism 50. As such, the supply tank 24 and the recovery tank 26 can easily be filled and/or emptied by an operator at a remote location. Optionally, as in the embodiment shown in FIG. 5, the supply tank 24 may include two or more compartments, such as a sanitizing fluid tank 52 for storing a sanitizing fluid, and a cleaning fluid tank 54 for storing a cleaning fluid such as water, detergent, or a mixture of water and detergent. As best illustrated in FIG. 5, the sanitizing fluid tank 52 includes a sanitizing fluid inlet 56 to allow sanitizing fluid to enter the sanitizing fluid tank 52, and a sanitizing fluid outlet 58 to discharge sanitizing fluid from the sanitizing fluid tank 52. Similarly, the cleaning fluid tank 54 includes a cleaning fluid inlet 60 to allow cleaning fluid to enter the cleaning fluid tank 54, and a cleaning fluid outlet 62 to discharge cleaning fluid from the cleaning fluid tank 54. The sanitizing fluid outlet 58 and the cleaning fluid outlet 62 include valves (not shown) that automatically open when the supply tank 24 is attached to the housing 22 and that automatically close when the supply tank 24 is removed from the housing 22, as in one example, poppet valves. In another embodiment, one or more of the fluid supply tank 24 and recovery tank 26 are not removeably coupled to the extractor cleaning machine 20, instead being configured for filling and emptying on the extractor 20.

Figure 6:
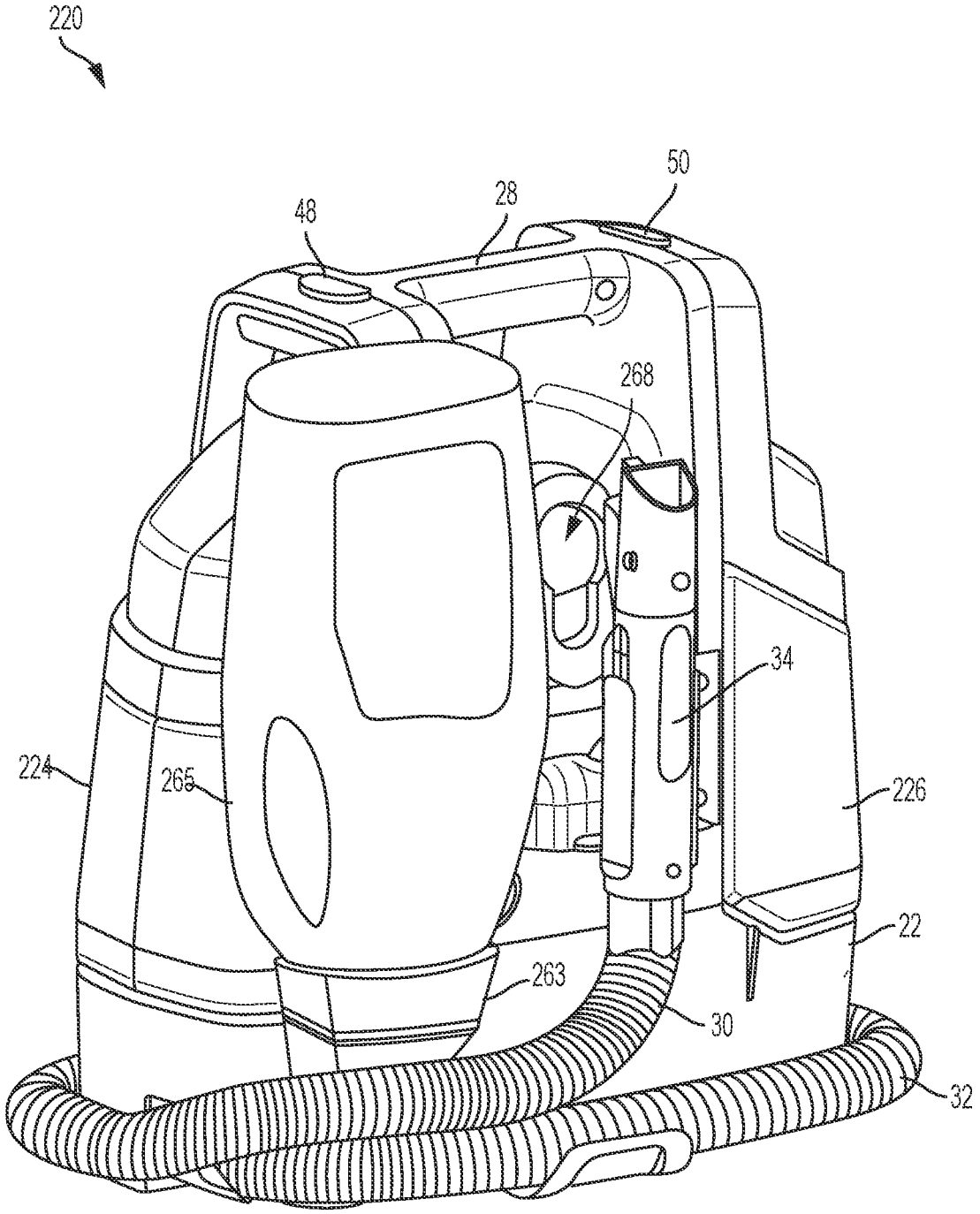
FIG. 6 is a perspective view of an extractor in accordance with another embodiment of the invention.
Figure 7:
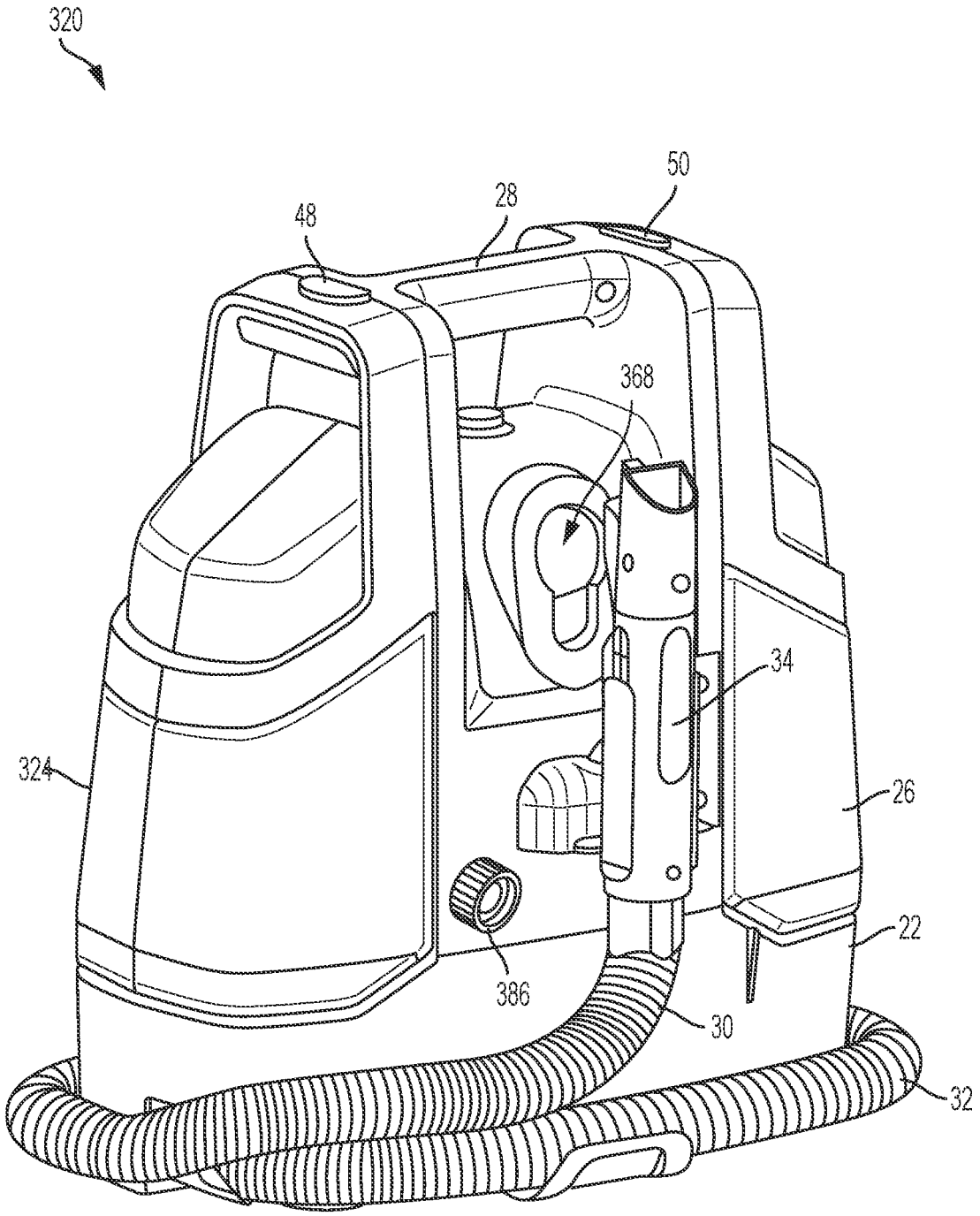
FIG. 7 is a perspective view of an extractor in accordance with another embodiment of the invention.

In the embodiment shown in FIG. 6, the extractor 220 includes a container inlet 263 in fluid communication with the cleaning chamber 268, the pump 64, or both, such that a container 265 receivable in the container inlet 263 is the supply tank 224, or is in addition to the supply tank 224. The container inlet 263 may be configured to receive a single-use container purchased at a retail or other commercial outlet, or a re-Tillable container, or other container for providing fluid to the extractor 220. For convenience, the extractor 220 including its supply tank 224 and fluid delivery system are stated and described using cleaning fluid and sanitizing fluid; however, the extractor 220 is not limited. All of the components of the extractor 220 may be configured to provide water, detergent, stain releaser, cleaner, sanitizer, maintainers, finishes, other fluids, or any mixture or mixtures thereof. In other embodiments such as FIG. 7, the extractor 320 includes a fluid inlet port 386 in fluid communication with the cleaning chamber 368. In this embodiment, the cleaning chamber 368 is configured to selectively receive fluid from the supply tank 324, the fluid inlet port 386, or a combination of the supply tank 324 and the fluid inlet port 386. The fluid inlet port 386 may be a hose connector configured for connecting a hose from a household plumbing fixture or faucet. Alternatively, the fluid inlet port 386 may be configured as a container inlet to receive fluid from a single-use container purchased at a retail or other commercial outlet, or a re-fillable container, or other container for providing fluid to the extractor 320.

With continued reference to FIG. 5, the extractor 20 further includes a fluid delivery system. The fluid delivery system includes a pump 64 that is in fluid communication with the supply tank 24 and further in communication with a switch (not shown). The switch is configured to deactivate the pump 64 and the suction source 29 in a first state. Otherwise, when the switch is in a second state, the fluid delivery system is enabled to selectively deliver cleaning fluid from the supply tank 24 through the pump 64, such as to the surface to be cleaned, along a first fluid flow path 66, which may include a tube or conduit, and through a distribution nozzle 42. The distribution nozzle 42 may be positioned adjacent the hose end 30 for distribution of fluid adjacent the accessory tool 34 when the accessory tool 34 is attached to the hose end 30, for example. Alternatively, the distribution nozzle 42 may be independent of the hose 32 attached to the housing 22 or remote from the housing 22. In the illustrated embodiment, the first fluid flow path 66 is supported along the hose 32 in order to be in communication with the distribution nozzle 42 on the hose end 30. As shown in FIG. 3, the hose end 30 includes a trigger 38 that, when depressed, activates the pump 64 to provide cleaning fluid through the distribution nozzle 42 from the supply tank 24. In an alternative embodiment, a controller is configured to deactivate and activate the pump 64 and the suction source 29 in response to one or more inputs such as the trigger 38 or a mode valve assembly 88 (FIG. 1) being actuated, amount of fluid in the supply tank 24 and/or recovery tank 26, pressure in the system, or other variables.

Figure 8:
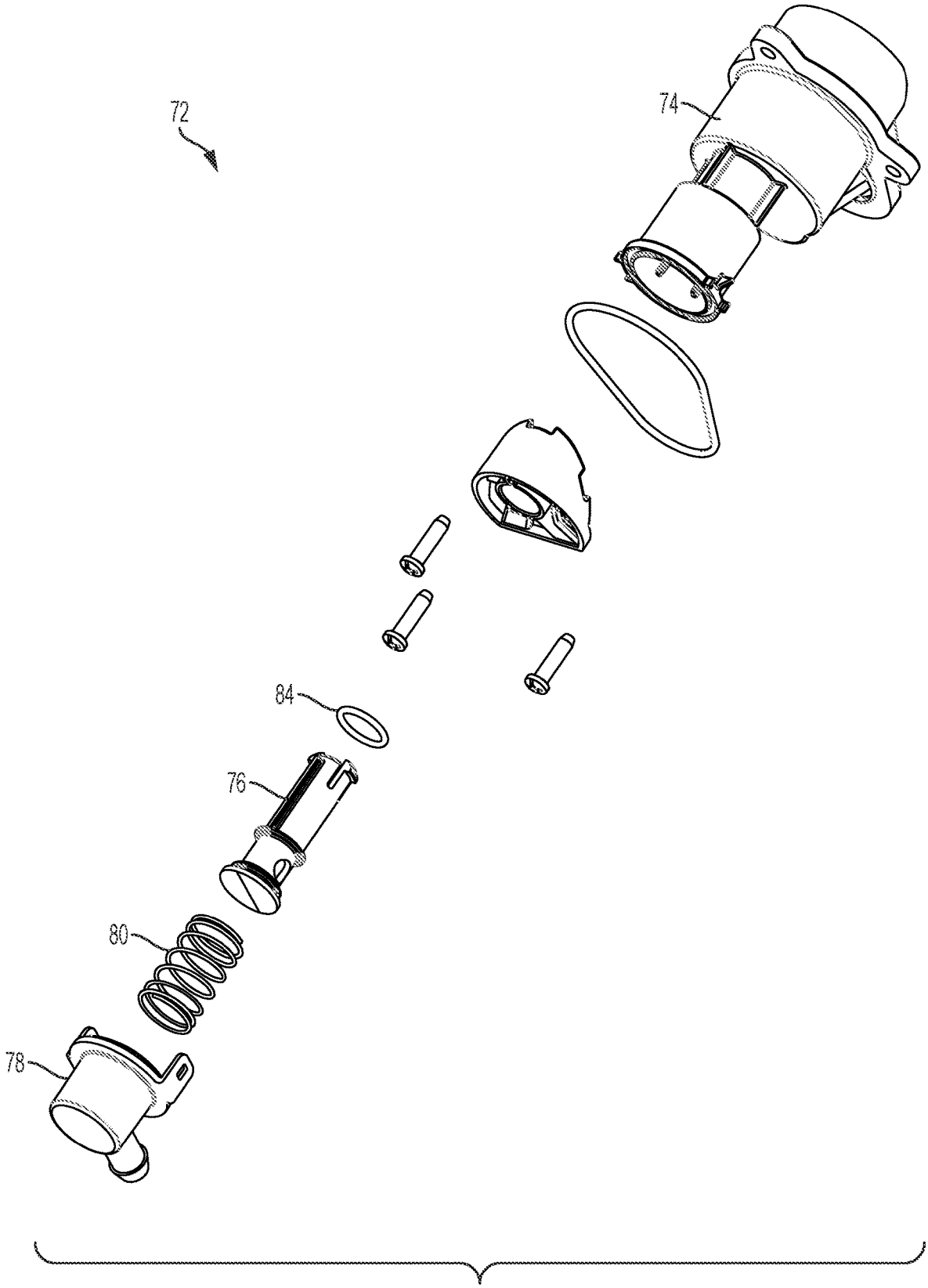
FIG. 8 is an exploded perspective view of the cleaning chamber valve of the extractor of FIG. 1.
Figure 9:
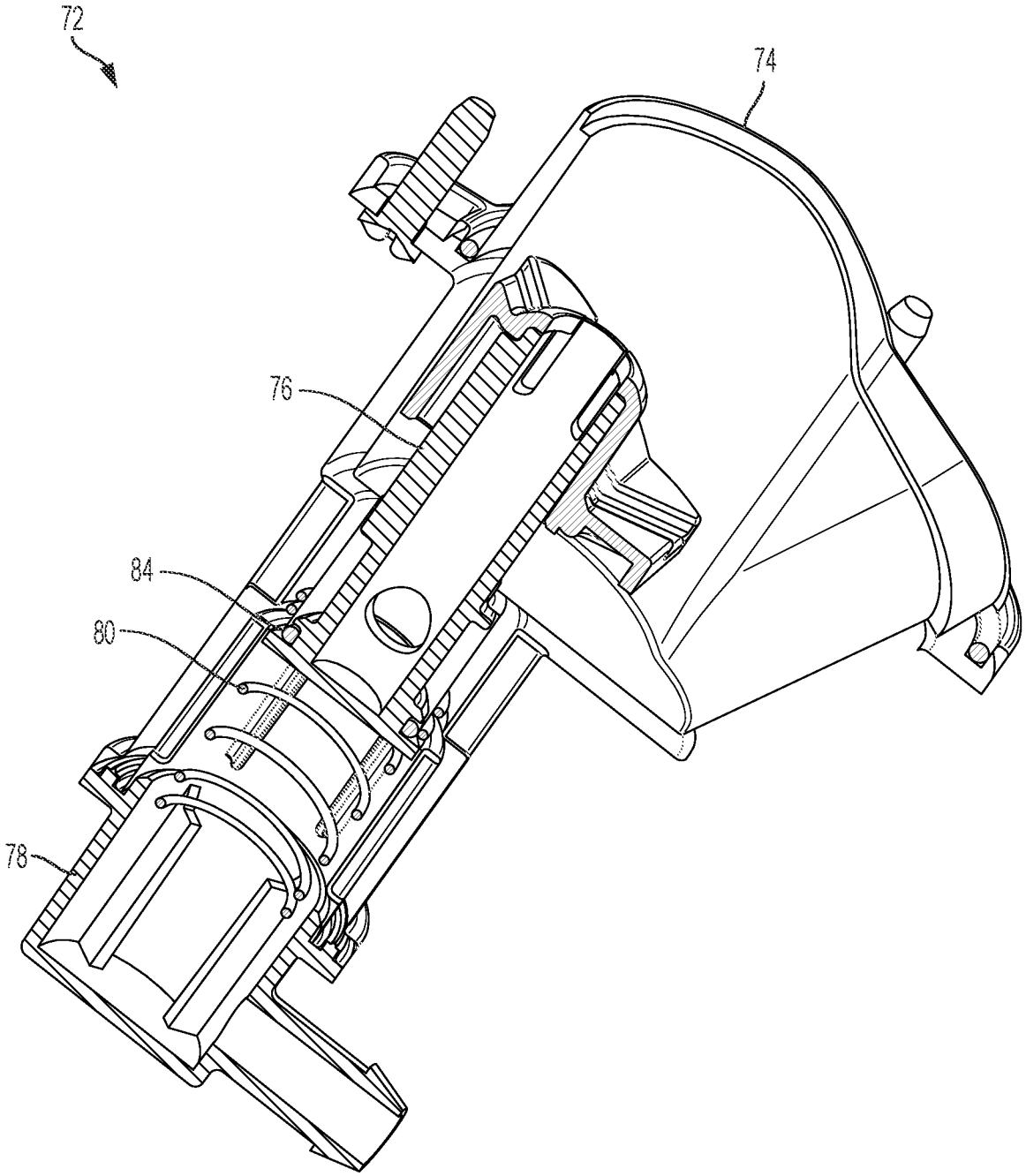
FIG. 9 is a cross-sectional perspective view of the cleaning chamber valve of FIG. 8.
Figure 10:
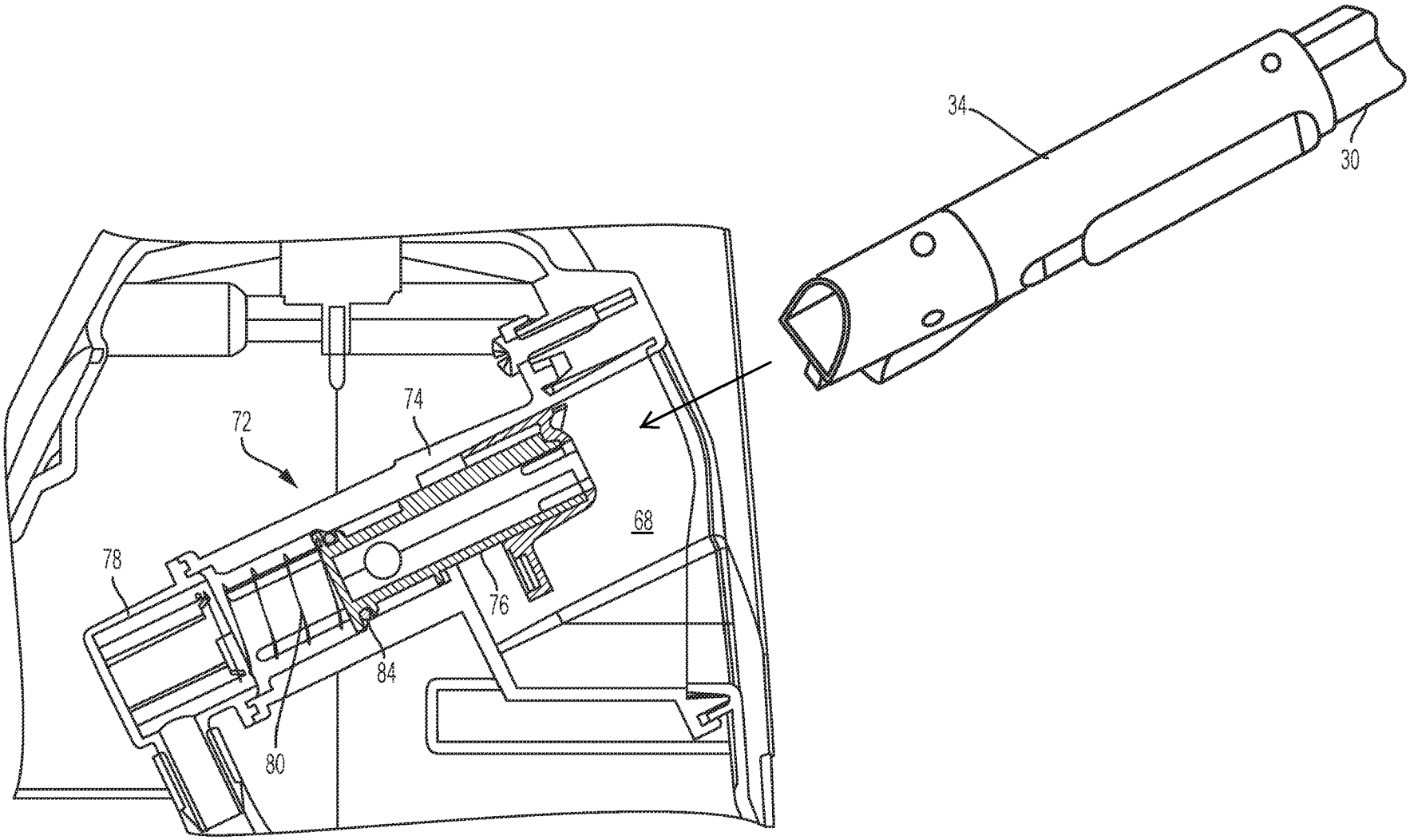
FIG. 10 is a cross-sectional view of a portion of the extractor taken along line 10-10 of FIG. 4, illustrating a suction nozzle being inserted into the cleaning chamber.

The illustrated extractor 20 is configured for the hose 32 to draw fluid from the supply tank 24, and optionally other sources, to flush fluid through the hose 32. With reference to FIGS. 8-10, the extractor 20 further includes a cleaning chamber 68. The cleaning chamber 68 is disposed on the housing 22 and is capable of receiving a portion of the hose end 30 (FIG. 10). The cleaning chamber 68 is configured to selectively receive fluid, such as one or more of the detergent fluid and the sanitizing fluid along a second fluid flow path 70 of the fluid delivery system. The extractor 20 further includes a cleaning chamber valve 72 (FIG. 8) configured to selectively permit introduction of the cleaning fluid into the cleaning chamber 68. The cleaning chamber valve 72 includes a valve housing 74 configure to receive at least a portion of the hose end 30, and a plunger 76 that is actuatable between a closed position to inhibit the cleaning fluid from entering the cleaning chamber 68, and an open position to permit the cleaning fluid to enter the cleaning chamber 68. In the illustrated embodiment, the plunger 76 has an outer diameter that is less than the inner diameter of the valve housing 74 such that an annular or other shaped gap exists between the plunger 76 and the valve housing 74. The cleaning chamber valve 72 further includes a port that is in communication with the supply tank 24. As shown in FIG. 9, the port may be integrally formed in a port housing 78. A spring 80 of the cleaning chamber valve 72 is interposed between the plunger 76 and a wall or surface opposite the plunger 76, such as the port housing 78 as shown in FIG. 9, to force the plunger 76 toward the closed position. In the illustrated embodiment, inserting the hose end 30 into the valve housing 74 actuates the plunger 76. The hose end 30 moves the plunger 76 toward the open position compressing the spring 80 when the hose end 30 is inserted into the cleaning chamber 68 (FIG. 10). In one alternative, not shown, the hose end 30 seals against the valve housing 74. Suction at the hose end 30 provided by the suction source 29 draws fluid along the second fluid flow path 70 extracting the cleaning fluid from the supply tank 24 and into the cleaning chamber 68. In turn, the cleaning fluid continues through the hose end 30, the hose 32, and into the recovery tank 26 flushing fluid through the hose end 30 and the hose 32 for purposes of at least partially cleaning the hose 32. In alternative embodiments, the plunger 76 may be actuated by an actuator operably connected a switch, lever, controller, or other mechanism for moving the plunger 76 between the closed position and the open position. In alternative embodiments, the port housing 78 is welded to, attached to, molded with, or otherwise integral with the valve housing 74.

The cleaning chamber valve 72 further includes one or more rubber gaskets or O-rings (i.e., a plunger seat gasket 84) to close the cleaning chamber valve 72 when the hose end 30 is not inserted in the cleaning chamber 68. Other gaskets or seals (not shown) may be provided as desired to prevent leakage of the cleaning fluid into or out of the cleaning chamber 68 and maintain suction in the cleaning chamber valve 72 when the hose end 30 is positioned in the cleaning chamber 68 suction and the suction source 29 activated.

Figure 11:
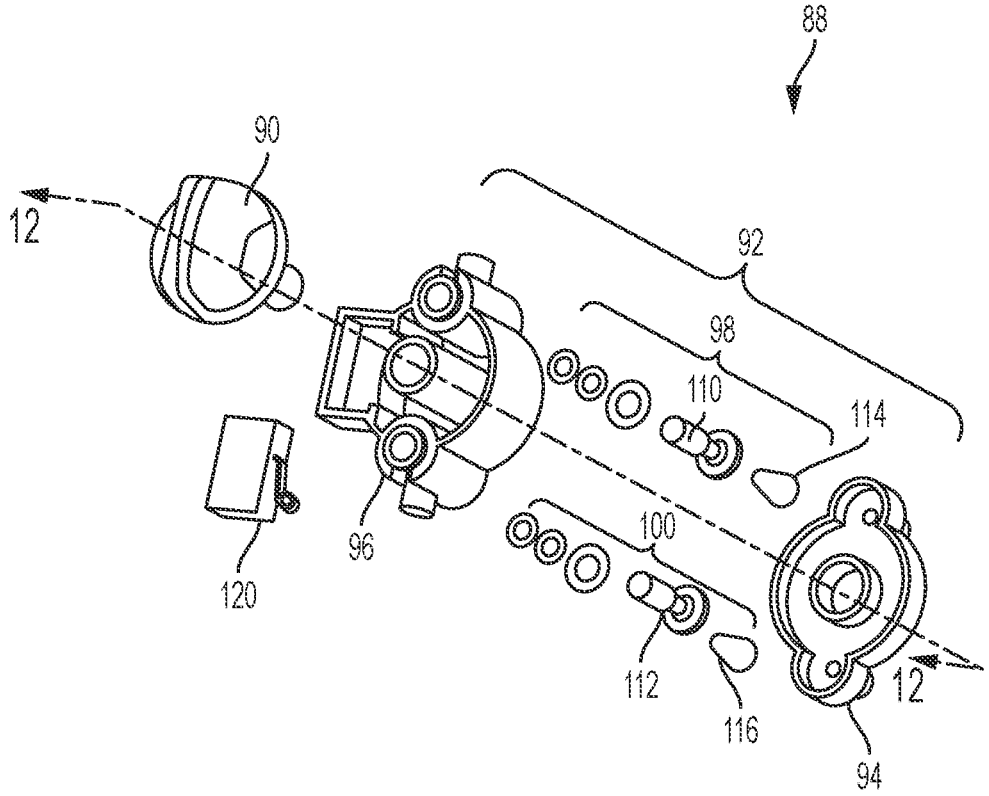
FIG. 11 is an exploded view of the mode valve assembly of the extractor of FIG. 1.
Figure 12:
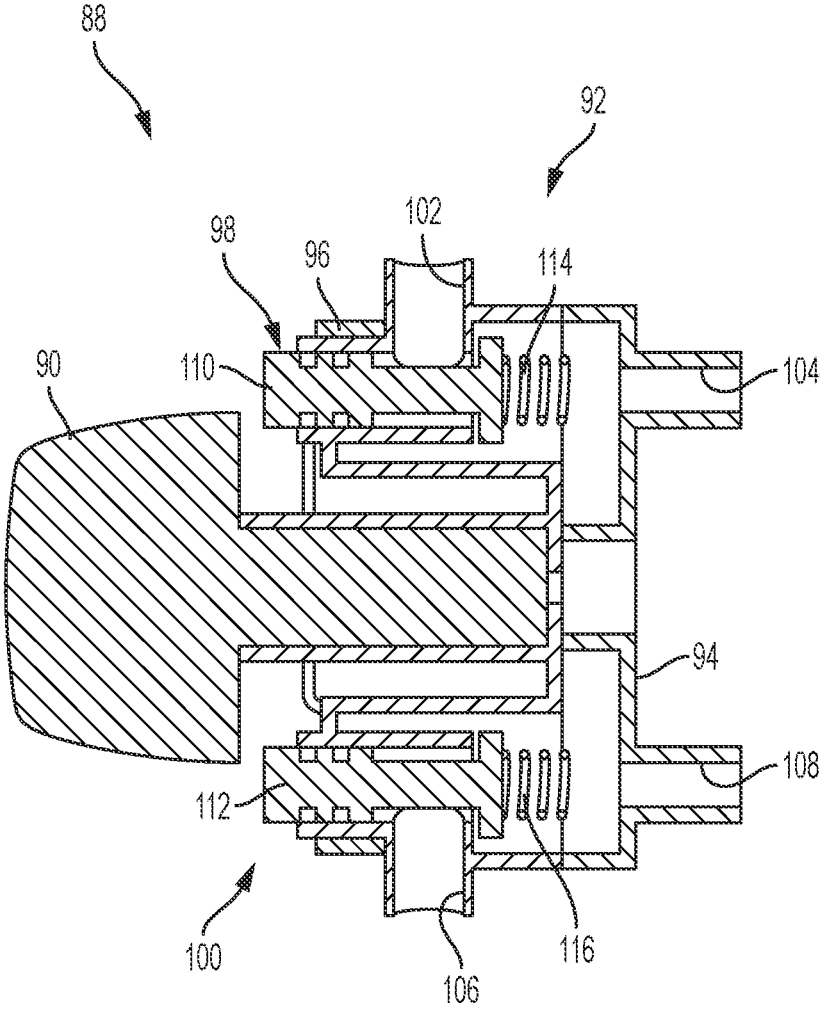
FIG. 12 is a cross-section view of the mode valve assembly taken along line 12-12 of FIG. 11, illustrating the mode valve assembly in a first position.

With reference to FIGS. 11-14, the extractor 20 further includes the mode valve assembly 88. The mode valve assembly 88 includes a mechanical valve 92 for selectively switching between a first position corresponding to a first mode (i.e., a deactivated suction mode) in which the suction source 29 is deactivated, a second position corresponding to a second mode (i.e., a wash mode) connecting the fluid delivery system to the cleaning fluid tank 54, and a third position corresponding to a third mode (i.e., a sanitize mode) connecting the fluid delivery system to the sanitizing fluid tank 52. The mode valve assembly 88 includes a first inlet port 102 in communication with the sanitizing fluid tank 52, a second inlet port 106 in communication with the cleaning fluid tank 54. The mode valve assembly 88 selectively connects the sanitizing fluid tank 52 and the cleaning fluid tank 54 with an outlet port in communication with the fluid flow path 66. In the illustrated embodiment, the mechanical valve 92 of the mode valve assembly 88 includes a valve cap 94, and a valve body 96 coupled to the valve cap 94 for at least partially supporting a first gate valve 98 and a second gate valve 100. As best illustrated in FIG. 12, the first gate valve 98 has the inlet port 102 in communication with the supply tank 24, and an outlet port 104 downstream of the inlet port 102 and in communication with the fluid delivery system and the cleaning chamber 68. Similarly, the second gate valve 100 has the inlet port 106 in communication with the supply tank 24, and an outlet port 108 downstream of the inlet port 106 and in communication with the fluid delivery system and the cleaning chamber 68. The outlet ports 104, 108 are in communication with each other. The first gate valve 98 includes a gate 110, and the second gate valve 100 also includes a gate 112, in which each gate 110, 112 is forced by springs 114, 116 toward a closed position. The mode valve assembly 88 includes a mode knob 90 that is user-manipulable and supported by the housing 22 to actuate the valve.

The mode knob 90 includes a cam body 118 (FIGS. 13 and 14) that protrudes away from the underneath-side of the mode knob 90 toward the valve body 96. The cam body 118 is selectively enagageable with the gate 110 of the first gate valve 98 and the gate 112 of the second gate valve 100 such that the cam body 118 is capable of imparting a force on the each gate 98, 110 to actuate each gate 98, 100 toward an open position. Further, the mode knob 90 is engageable with a micro-switch 120 (e.g., a limit switch) of the mode valve assembly 88 to electrically communicate with the motor 31 of the suction source 29 and the pump 64 of the fluid delivery system such that the mode knob 90 is capable of activating and deactivating the motor 31 and the pump 64 (FIG. 11). Specifically, the mode knob 90 engages the micro-switch 120 in the first position to deactivate the motor 31 and the pump 64, whereas the mode knob 90 engages the micro-switch 120 in the second position and third position to activate the motor 31 and the pump 64. In other embodiments, the micro-switch 120 may be supported by the housing 22 of the extractor 20 and user-manipulable such that an operator can directly depress the micro-switch 120 and control operation of the motor 31 and the pump 64.

Figure 13:
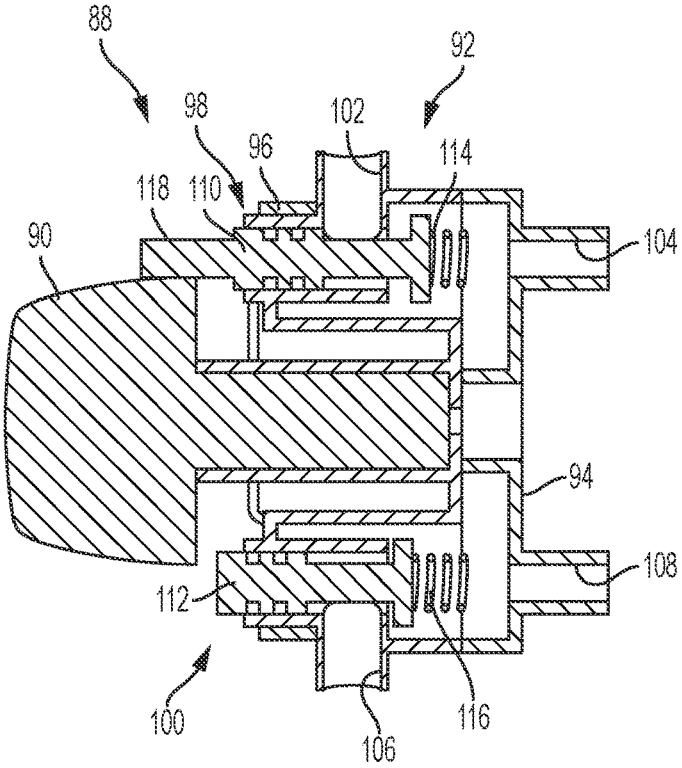
FIG. 13 is a similar cross-section view as FIG. 12, illustrating the mode valve assembly in a second position.
Figure 14:
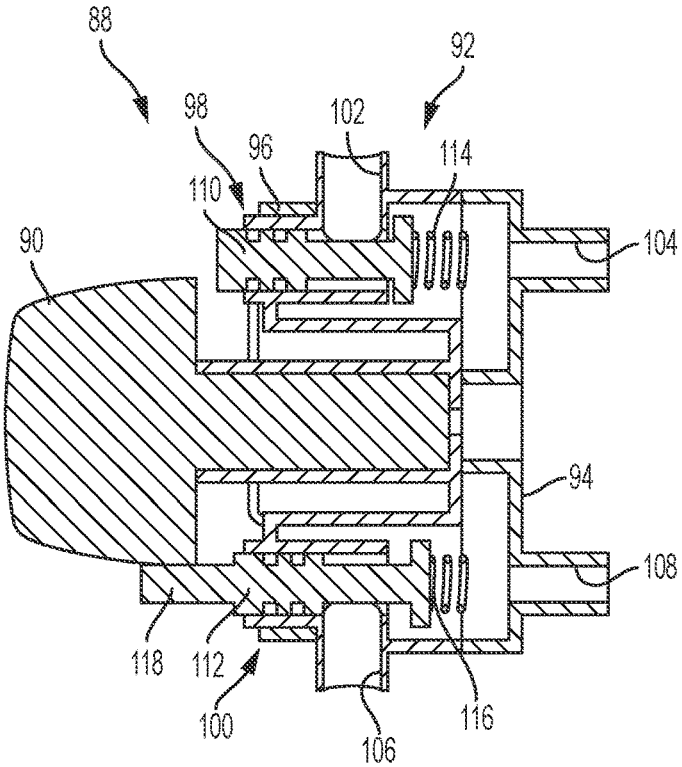
FIG. 14 is a similar cross-section view as FIG. 12, illustrating the mode valve assembly in a third position.

During use, an operator manipulates (e.g., rotates) the mode knob 90 away from the deactivated suction mode, in which the gates 110, 112 of the first gate valve 98 and the second gate valve 100 are forced by the springs 114, 116 in the closed position. To wash or sanitize the surface, an operator rotates the mode knob 90 to the wash mode or the sanitize mode, respectively. When the mode knob 90 is rotated, for example, to the wash mode, the motor 31 and the pump 64 are activated and the cam body 118 moves the gate 110 of the first gate valve 98 toward the open position to permit the detergent fluid to flow through the gate 110 from the cleaning fluid tank 54 while the gate 112 of the second gate valve 100 is in the closed position (FIG. 13). Conversely, when an operator rotates the mode knob 90, for example, to the sanitize mode, the motor 31 and the pump 64 remain activated and the cam body 118 moves the gate 112 of the second gate valve 100 toward the open position to permit the sanitizing fluid to flow through the gate 112 from the sanitizing fluid tank 52 while the gate 110 of the first gate valve 98 is in the closed position (FIG. 14). As such, the cleaning fluid (i.e., detergent fluid or sanitizing fluid) flows along the first fluid path 66 and is pumped by the pump 64 onto the surface to be cleaned through the distribution nozzle 42 (if the trigger 38 is depressed). If the trigger 38 is not depressed, the pump 64 may continue to operate, but the cleaning fluid is not discharged from the distribution nozzle 42. The suction source 29 simultaneously draws dirty fluid and waste from the surface through the hose end 30 where the recovery tank 26 receives and stores the dirty fluid and waste. However, some dirty fluid and waste may remain on the hose end 30 and/or hose 32 after cleaning the surface. Therefore, the cleaning chamber 68 is provided to wash or flush (e.g., sanitize) the hose end 30 and hose 32 in wash mode or sanitize mode, respectively.

In order to wash or flush the hose end 30, an operator inserts the hose end 30 into the cleaning chamber 68. Subsequently, the plunger 76 moves toward the open position to introduce the cleaning fluid (i.e., the detergent fluid or the sanitizing fluid) into the cleaning chamber 68. The cleaning fluid flows through the supply tank 24, the second fluid flow path 70, the port housing 78, and the gap between the plunger 76 and the valve housing 74. The cleaning fluid is provided to the cleaning chamber 68 at least partially by gravity and suction from the suction source 29. In other embodiments, the cleaning fluid may be supplied to the cleaning chamber 68 via the pump 64 of the fluid delivery system, either individually or in combination with suction from the suction source 29.

Figure 15:
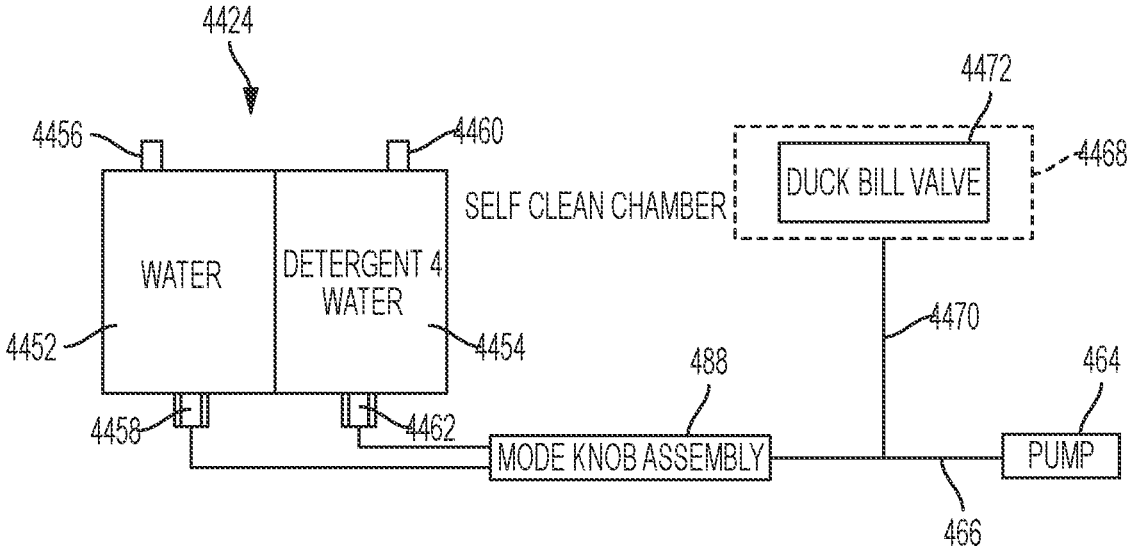
FIG. 15 is a schematic of a portion of an extractor according to another embodiment of the invention.

FIG. 15 illustrates a portion of the extractor 420 having a cleaning chamber 468 according to another embodiment. The extractor 420 is similar to the extractor 20 described above with reference to FIGS. 1-12, and similar parts have been given the same reference number plus 400. Only differences between the embodiments are described.

Figure 16:
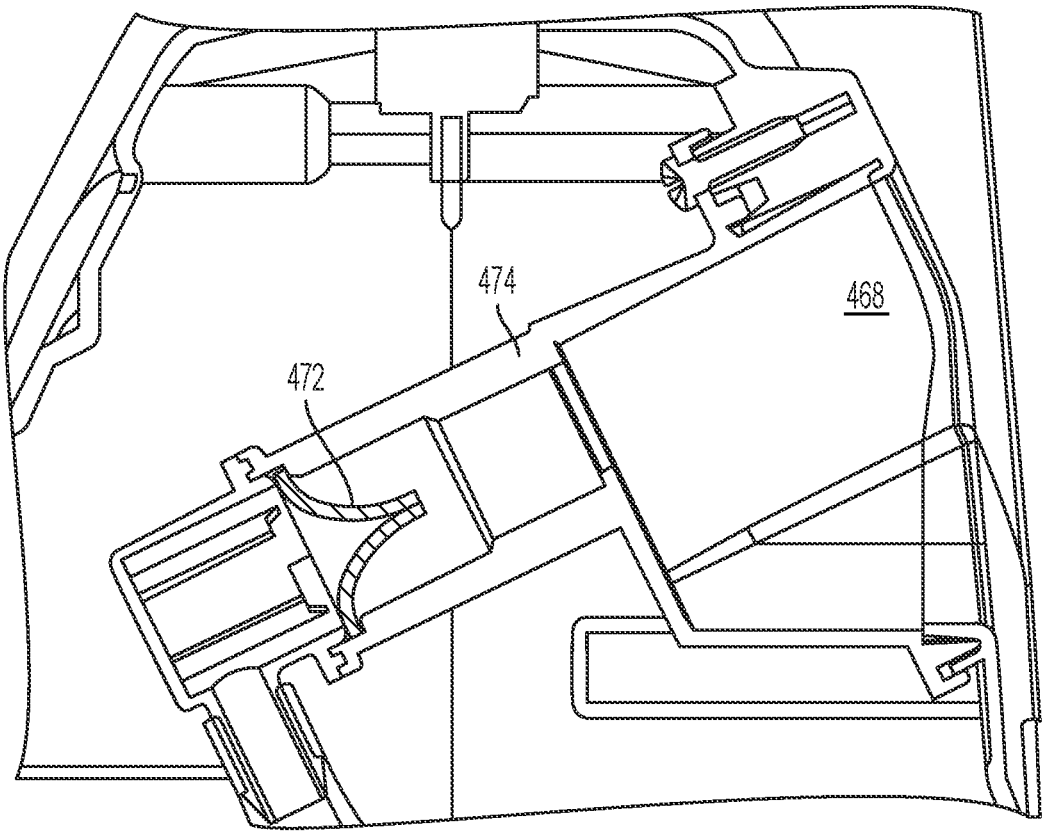
FIG. 16 is a cross-section view of a portion of the extractor of FIG. 15.

As shown in FIGS. 15 and 16, the cleaning chamber 468 of the illustrated embodiment includes a duckbill valve 472 instead of the cleaning chamber valve 72 to selectively permit introduction of the cleaning fluid into the cleaning chamber 468. The duckbill valve 472 includes a first end having an opening, and an intermediate portion that converges toward a second end having a flat gate. The duckbill valve 472 is disposed within the cleaning chamber 468 in communication with the supply tank 424 via the second fluid flow path 470. The flat gate of the duckbill valve 472 is moveable between a closed or "default" position, in which fluid is inhibited to flow (i.e., prevent backflow from the supply tank 424 to the cleaning chamber 468), and an open position, in which fluid is permitted to flow.

In operation, the hose end 430 is inserted in the cleaning chamber 468. Suction at the hose end 430 provided by the suction source draws fluid along the fluid flow path 470 through the duckbill valve. As such, the cleaning fluid is permitted to enter the hose end 430. Alternatively or additionally, the cleaning fluid is supplied to the cleaning chamber 468 via the pump 464 of the fluid delivery system.

Figure 17:
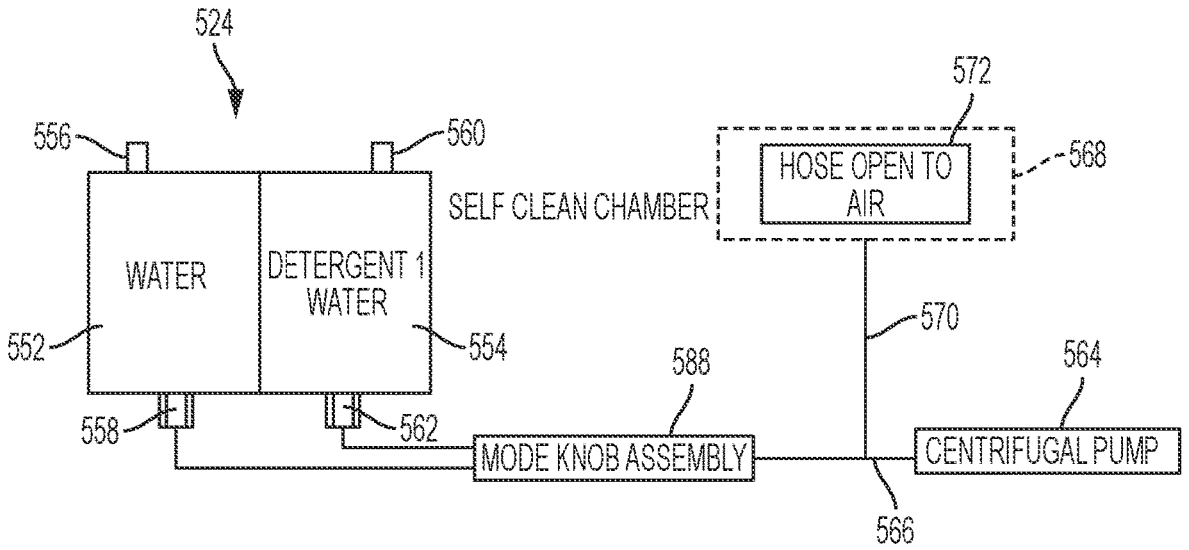
FIG. 17 is a schematic of a portion of an extractor according to another embodiment of the invention.

FIG. 17 illustrates a portion of the extractor 520 having a cleaning chamber 568 according to another embodiment. The extractor 520 is similar to the extractor 20 described above with reference to FIGS. 1-12, and similar parts have been given the same reference number plus 500. Only differences between the embodiments are described.

As shown in FIG. 17, the cleaning chamber 568 of the illustrated embodiment is in communication with the second fluid flow path 570 and the supply tank 3524 without a valve disposed therebetween. Specifically, the second fluid flow path 570 is open to air. In this case, the pump 564 does not feed the cleaning fluid to the cleaning chamber 568. Rather, the suction at the hose end 530 provided by the suction source 29 is utilized for drawing the cleaning fluid from the supply tank 524 to the cleaning chamber 568 when the hose end 530 is disposed in the cleaning chamber 568. Also, gravity may work alone or in combination with the suction source 529 to provide a gravity feed of the cleaning fluid into the cleaning chamber 568. The pump 564 is a centrifugal pump and is utilized strictly to feed the cleaning fluid along the first fluid flow path 566 toward the accessory tool 534. Occasionally, air may collect in the centrifugal pump 564 which, in turn, requires the pump 564 to be primed (i.e., filled totally with water) prior to operating. Leaving the second fluid flow path 570 open to air enables the pump 564 to be primed with ease.

During operation, the hose end 530 is inserted in the cleaning chamber 568. Subsequently, the suction at the hose end 530 provided by the suction source 529 draws cleaning fluid from the supply tank 524 along the second fluid flow path 570. Cleaning fluid can also be fed along the first fluid flow path 566 via the centrifugal pump 564 toward the surface to be cleaned. Air that is entrained during operation of the centrifugal pump 564 escapes to atmospheric air through the second fluid flow path 570. In other embodiments, suction of the suction source 529 may work in combination with gravity feed to deliver the cleaning fluid to the cleaning chamber 568.

Figure 18:
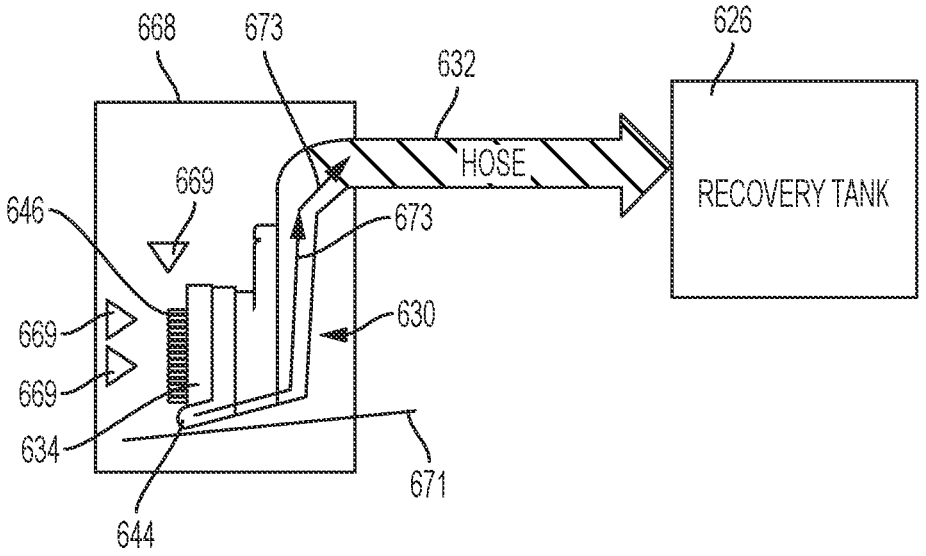
FIG. 18 is a schematic of a portion of an extractor according to another embodiment of the invention.

FIG. 18 illustrates a portion of an extractor 620 having a cleaning chamber 668 according to another embodiment. The extractor 620 is similar to the extractor 20 described above with reference to FIGS. 1-12, and similar parts have been given the same reference number plus 600. Only differences between the embodiments are described.

As shown in FIG. 18, the accessory tool 634 operates as the suction nozzle. As such, the cleaning chamber 668 receives the accessory tool 634 in its entirety. In some embodiments, the cleaning chamber 668 may receive only a portion of the accessory tool 634 (e.g., the intake nozzle 644 and agitator 646), in which case is more suitable if the agitator 646 is a rotary brush that spins in response to a turbine that rotates as air is drawn passed the turbine. Although the accessory tool 634 of the illustrated embodiment is mounted vertically within the cleaning chamber 668, the accessory tool 634 may be mounted horizontally within the cleaning chamber 668 or in any other orientation. In any orientation, the intake nozzle 644 can be positioned at a low point within the cleaning chamber 668 so as to draw out all of the liquid from the cleaning chamber 668. Optionally, at least one spray jet 669 is in communication with second fluid flow path 670 and provided within the cleaning chamber 668 to direct the cleaning fluid toward the accessory tool 634 to clean the accessory tool 634 and/or the agitator 646 of the accessory tool 634. The accessory tool 634 is coupled to the hose end 630 and hose 632, which is further in communication with the suction source 629 and the recovery tank 626.

During operation, the accessory tool 634 is mounted within the cleaning chamber 668. The cleaning fluid is expelled from the at least one spray jet 669 toward the accessory tool 634 to clean the accessory tool 634 of waste, and the cleaning fluid and waste is temporarily collected within the cleaning chamber 668. Once the cleaning fluid collected in the cleaning chamber 668 reaches a predetermined height such as along an inclined floor of the chamber 668 (indicated by line 671), the cleaning fluid and waste are drawn into the intake nozzle 644 of the accessory tool 634 (indicated by arrows 673). Thus, the accessory tool 634, the intake nozzle 644, and the hose 632 are cleaned simultaneously, while the cleaning fluid and waste are discharged into the recovery tank 626.

Figure 19:
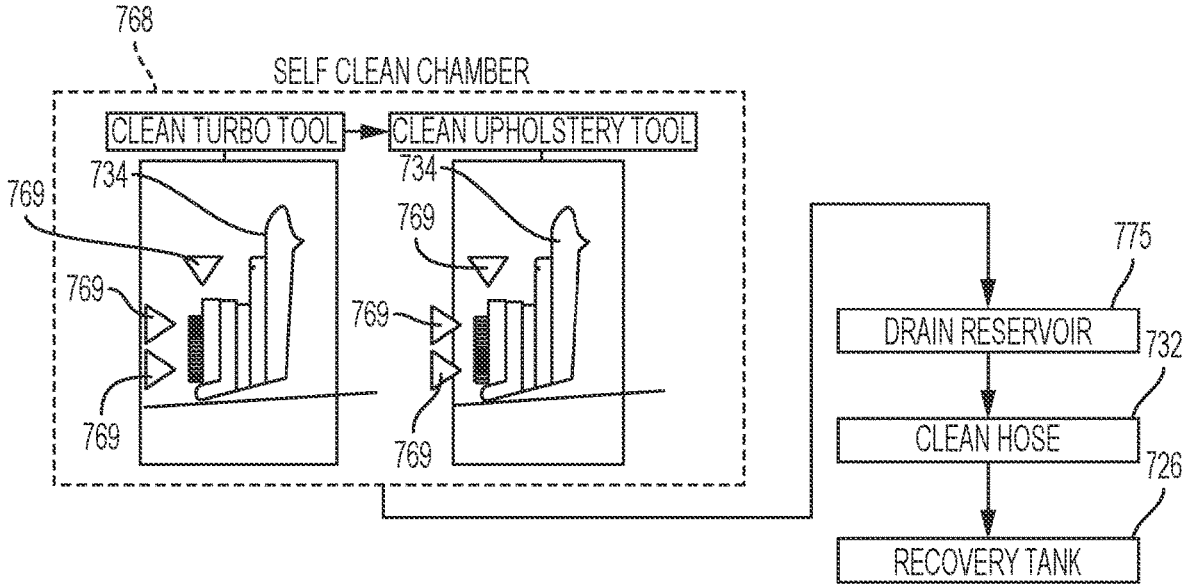
FIG. 19 is a schematic of a portion of an extractor according to another embodiment of the invention.

FIG. 19 illustrates a portion of the extractor 720 having a cleaning chamber 768 according to an alternative embodiment. The extractor 720 is similar to the extractor 620 described above with reference to FIG. 18, and similar parts have been given the same reference number plus 100. Only differences between the embodiments are described.

As shown in FIG. 19, the accessory tool 734 is a plurality of accessory tools that are received within the cleaning chamber 768 to clean the accessory tools 734 of waste. In the illustrated embodiment, the hose end 730 and hose 732 are coupled to the cleaning chamber 768 via a drain reservoir 775, such that the hose 732 does not connect to either of the accessory tools 734. In an alternative embodiment, the accessory tools 734 may be connected together and to the hose 732 via a split or T-hose in a similar construction to the embodiment of FIG. 18.

During operation, the fluid expelled from the at least spray jet 769 toward the plurality of accessory tools 734 is collected in the cleaning chamber 768. In this case, the cleaning fluid and waste that is collected in the cleaning chamber 768 is drawn out of the cleaning chamber 768 through the drain reservoir 775. Subsequently, the cleaning fluid and waste flows through the hose 732 and expelled and stored in the recovery tank 726.

Thus, the invention provides, among other things, a self-cleaning system for an extractor cleaning machine. Although the invention has been described in detail with reference to certain preferred embodiments, variations and modifications exist within the scope and spirit of one or more independent aspects of the invention as described.

What is claimed is:

1. A handheld extractor comprising:

a housing including a first side, a second side, and a third side;

a suction source within the housing;

a hose in communication with the suction source, the hose forming a suction nozzle movable relative to the housing;

a supply tank configured to store a cleaning fluid, the supply tank carried by the housing adjacent the first side of the housing;

a distribution nozzle;

a first fluid flow path between the supply tank and the distribution nozzle;

a fluid delivery system in communication with the supply tank via the first fluid flow path, the fluid delivery system delivers the cleaning fluid from the supply tank to a surface to be cleaned through the distribution nozzle;

a recovery tank carried by the housing adjacent the second side of the housing, the suction source in communication with the recovery tank and the hose for drawing fluid through the hose and storing the drawn fluid in the recovery tank;

a cleaning chamber in the third side of the housing; and a second fluid flow path extending within the housing from the supply tank to the cleaning chamber, a cleaning chamber valve that permits introduction of the cleaning fluid into the cleaning chamber when the suction nozzle is received in the cleaning chamber and the cleaning chamber includes a valve housing, wherein the cleaning chamber receives the suction nozzle and the suction source provides suction through the hose and the second fluid flow path to extract the cleaning fluid from the supply tank, along the second fluid flow path into the cleaning chamber, through the hose and into the recovery tank to flush the cleaning fluid through the hose to clean the hose when the suction nozzle is received in the cleaning chamber, wherein the valve housing also receives a portion the suction nozzle, and wherein the cleaning chamber valve includes a plunger that is actuatable between a closed position to inhibit the cleaning fluid from entering the cleaning chamber and an open position to permit the cleaning fluid to enter the cleaning chamber through the plunger.

2. The handheld extractor of claim 1, wherein the second side of the housing is directly opposed to the first side of the housing.

3. The handheld extractor of claim 2, wherein the third side of the housing extends from the first side to the second side of the housing.

4. The handheld extractor of claim 3, wherein the housing includes a handle to facilitate moving and carrying the handheld extractor, wherein the handle extends in a longitudinal direction extending between the first side of the housing and the second side of the housing.

5. The handheld extractor of claim 4, wherein the handle is located at a top of the housing.

6. The handheld extractor of claim 5, wherein the cleaning chamber is in an area of the third side bounded by the handle, the supply tank, and the recovery tank.

7. The handheld extractor of claim 6, further comprising an opening located between the handle and the housing, wherein the cleaning chamber is located directly below the opening.

8. The handheld extractor of claim 1, wherein the distribution nozzle is adjacent the suction nozzle.

9. The handheld extractor of claim 1, wherein the cleaning chamber has a shape that corresponds to a shape of the suction nozzle such that the suction nozzle seals against the cleaning chamber.

10. The handheld extractor of claim 1, wherein the plunger has an outer diameter that is less than the inner diameter of the valve housing such that an annular gap exists between the plunger and the valve housing.

11. The handheld extractor of claim 1, wherein the suction nozzle contacts the plunger when the suction nozzle is inserted into the cleaning chamber to move the plunger from the closed position to the open position.

12. The handheld extractor of claim 1, wherein the housing includes an upwardly extending portion disposed between the supply tank and the recovery tank.

13. The handheld extractor of claim 12, wherein the cleaning chamber is disposed in the upwardly extending portion of the housing.

14. An extractor comprising:

a housing including a first side, a second side, and a third side;

a suction source within the housing;

a hose in communication with the suction source, the hose forming a suction nozzle movable relative to the housing;

a supply tank configured to store a cleaning fluid, the supply tank carried by the housing;

a distribution nozzle;

a first fluid flow path between the supply tank and the distribution nozzle;

a fluid delivery system in communication with the supply tank via the first fluid flow path, the fluid delivery system delivers the cleaning fluid from the supply tank to a surface to be cleaned through the distribution nozzle;

a recovery tank carried by the housing, the suction source in communication with the recovery tank and the hose for drawing fluid through the suction nozzle and through the hose and storing the drawn fluid in the recovery tank;

a cleaning chamber including an opening having a cylindrical portion; and a second fluid flow path extending within the housing from the supply tank to the cleaning chamber, a cleaning chamber valve that permits introduction of the cleaning fluid into the cleaning chamber when the suction nozzle is received in the cleaning chamber and the cleaning chamber includes a valve housing, wherein the cleaning chamber receives the suction nozzle through the cylindrical portion of the opening and the suction source provides suction through the hose and the second fluid flow path to extract the cleaning fluid from the supply tank, along the second fluid flow path into the cleaning chamber, through the hose and into the recovery tank to flush the cleaning fluid through the hose to clean the hose when the suction nozzle is received in the cleaning chamber, wherein the valve housing also receives a portion the suction nozzle, and wherein the cleaning chamber valve includes a plunger that is actuatable between a closed position to inhibit the cleaning fluid from entering the cleaning chamber and an open position to permit the cleaning fluid to enter the cleaning chamber through the plunger.

15. The extractor of claim 14, wherein the opening of the cleaning chamber is keyhole shaped.

16. The extractor of claim 14, wherein the suction nozzle includes a cylindrical portion that corresponds to the cylindrical portion of the cleaning chamber such that the suction nozzle seals against the cleaning chamber.

17. The extractor of claim 14, wherein the plunger has an outer diameter that is less than the inner diameter of the valve housing such that an annular gap exists between the plunger and the valve housing.

18. The extractor of claim 14, wherein the suction nozzle contacts the plunger when the suction nozzle is inserted into the cleaning chamber to move the plunger from the closed position to the open position.

* * * * *